United States Patent [19]

Bobrick

[11] 4,147,285

[45] Apr. 3, 1979

[54] SPRING CLIP FOR JEWELRY BAND

[76] Inventor: Samuel M. Bobrick, 445 Monaco, Denver, Colo. 80220

[21] Appl. No.: 757,454

[22] Filed: Jan. 6, 1977

[51] Int. Cl.[2] ..... A44C 5/14

[52] U.S. Cl. ..... 224/177; 24/265 WS; 63/4

[58] Field of Search ..... 224/4 E, 4 D, 28 W, 224/4 H; 63/4; 59/80, 91, 82, 78, 90, 35; 24/265 WS, 265 B, 241 WB, 236, 233, 265 H

[56] References Cited

U.S. PATENT DOCUMENTS

| | | | |
|---|---|---|---|
| 1,746,457 | 2/1930 | Bigney et al. | 224/4 D UX |
| 3,550,216 | 12/1970 | Gandelman | 24/265 WS X |

FOREIGN PATENT DOCUMENTS

| | | | |
|---|---|---|---|
| 173477 | 3/1935 | Switzerland | 24/265 WS |
| 390077 | 3/1933 | United Kingdom | 24/265 WS |

*Primary Examiner*—Trygve M. Blix

*Assistant Examiner*—Jerold M. Forsberg

*Attorney, Agent, or Firm*—John E. Reilly

[57] ABSTRACT

A jewelry wristband is characterized by a flexible section adapted to conform to the wrist of the wearer with spring clips at each end to permit positive but releasable connection of jewelry or watch tips which are adapted to be placed at opposite ends of the watch. In addition, an intermediate expander section comprising arcuate plates hinged together is interposed in the flexible section to facilitate adjustment of the length of the flexible section to conform to the size of the wrist. The spring closure at each end of the flexible sections has a closed end of arcuate configuration and broad flat, generally rectangular leaf spring portions which diverge away from the connecting ends of the flexible section within the closed end, one spring portion being biased into a closed position within the return portion of the closed end so as to securely retain the ends of a watch tip or the like in place.

6 Claims, 6 Drawing Figures

SPRING CLIP FOR JEWELRY BAND

This invention generally relates to wrist bands, and more particularly relates to a jewelry wristband of the type adapted for interconnection of segments of jewelry customarily referred to as watch tips to opposite ends of a flexible section so as to flank opposite ends of a watch while permitting ready conformability of the entire band to different sized wrists.

BACKGROUND OF THE INVENTION

Wristbands are customarily made up of flexible sections separated by an intermediate expander assembly together with connectors at opposite ends of the flexible sections which can be snap-connected to the casing of a watch. In certain cases, when it is desired to add decorative accessories to the watch, such as, jewelry items between the ends of the flexible section and watch, the flexible sections must be shortened and also provided at their ends with a quick but positive means of fastening the jewelry or watch tips as they are customarily referred to in the trade. Generally in the past this has been done by spring-loaded pins; also, spring retainers have been devised to form spring-type closures of the type in which a leaf spring element is normally biased into a closed position against the return portion of a generally hook-shaped end and can be depressed away from the return portion to permit insertion of a bar or pin past the spring. However, spring retainers of this type in the past have generally been subject to weakening and misalignment so as not to form a proper closure under repeated use.

Expander sections have been employed in the past as a bridge between portions of the flexible sections to facilitate placement and removal of the watchband on the wrist without necessity of expanding the flexible sections. A type similar to that of the present invention employs hinged together arcuate plates which in the closed position are normally collapsed against the underside of a clasp, one end of a plate being adjustably attached to the clasp by a spring-loaded pin having opposite ends releasably inserted into aligned openings in side channels formed on the clasp. Similarly, one of the flexible sections is releasably attached to another pair of aligned openings in the clasp by a spring-loaded pin. A drawback of the expander sections now in use is the manner of snap connecting the arcuate plates in the closed or collapsed position which limits adjustability of the flexible sections, making it difficult to have the same effective length of sections and be symmetrical with respect to the entire band.

SUMMARY OF THE INVENTION

It is therefore an object of the present invention to provide for a novel and improved wristband which is particularly adaptable for releasably fixing items of jewelry or watches in position on the wrist.

It is another object of the present invention to provide for a novel and improved spring clip for wristbands to facilitate attachment of watch or casting tips to the band and specifically wherein the watch tip is interconnected between free ends of a flexible section of the band and the watch itself.

It is a further object of the present invention to provide in a wristband for a novel and improved expander section which will permit independent adjustment of flexible sections to the expander section so as to permit equal lengthening or shortening of each flexible section as required without interfering with closure of the expander section.

In accordance with the present invention, there has been devised a watchband of a type having a flexible section which is adapted to conform to the wrist and at least one end of which will permit releasable connection of a watch or casting tip and the like by means of a conventional crosspin or bar. This is accomplished by a spring retainer assembly at the end of the flexible section provided with a return portion terminating in a free end spaced from the connecting side of the retainer to form an entrance for insertion of the connecting bar. A spring closure has a common connecting end attached to the end of the flexible section with flat, generally rectangular leaf springs diverging away from the connecting ends for extension between the opposite sides of the retainer, one spring portion biased against the inner surface of the terminal end and the other spring portion biased to incline in a direction toward the one side so that when the one spring portion is depressed, it will be resisted to some extent by the other portion. In a preferred embodiment, the other spring portion is made up of spaced spring fingers extending away from a looped connecting end and the spring closure has a cross section in the general shape of a keyhole with the looped connecting end bent closely around a pin at the end of the flexible section. Adjustability is provided between the flexible sections by means of an expander portion having arcuate plates hinged together at one end and the opposite end of each being hinged to a portion of the flexible section. The arcuate plates can be collapsed inwardly into superimposed relation beneath a spring clasp and fastened together by a snap-on portion extending transversely of the length of one plate and projecting toward the rounded end of the other plate and being aligned for snap-fitting engagement over the rounded end. Snap-fitting closure in this manner permits utilization of the spring-loaded pins or the like which are selectively aligned with aligned adjustment openings along opposite sides of a spring clasp overlaying the arcuate plates in the closed position so that each of the flexible sections can be symmetrically adjusted with respect to the spring clasp without interfering with closure of the arcuate plates of the expander sections.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED AND MODIFIED EMBODIMENTS OF THE PRESENT INVENTION

Figure 1:
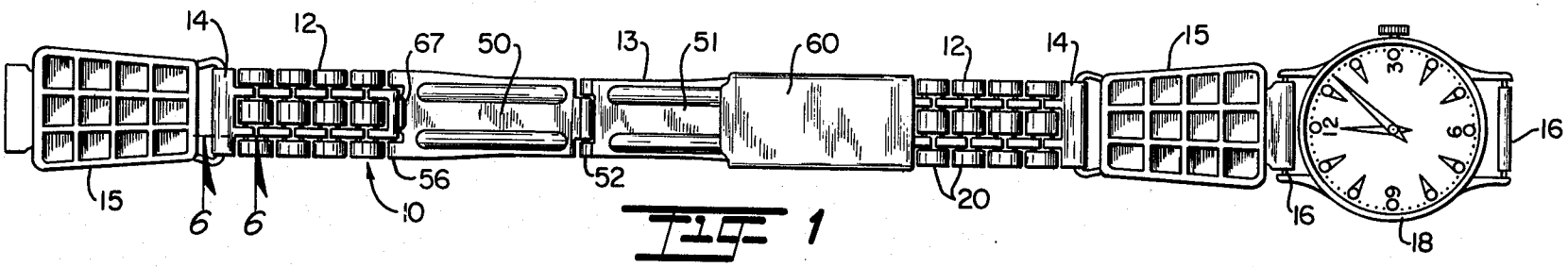
FIG. 1 is a top plan view of the preferred embodiment in assembled relation on a jewelry wristband.
Figure 2:
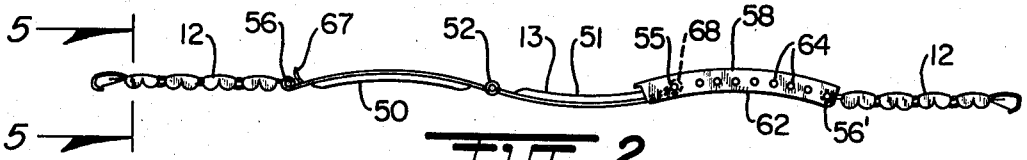
FIG. 2 is a detailed view, enlarged, of the spring clip assembly interposed between the flexible section of the wristband and a watch tip.
Figure 3:
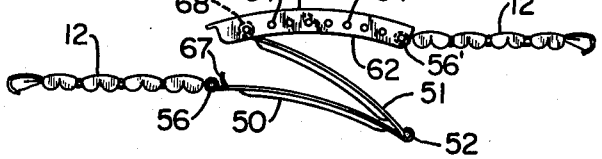
FIG. 3 is a view of the expander section in a partially collapsed position.

Referring in more detail to the drawings, there is shown by way of illustrative example in FIG. 1 a jewelry wristband 10 which is broadly comprised of a pair of flexible sections 12 joined together by an expander section 13 at one end, the opposite ends of the flexible sections provided with a preferred form of spring clip 14 in accordance with the present invention for the purpose of releasable interconnection of conventional item of jewelry customarily referred to as a watch tip 15. Also in a conventional manner, the watch tip 15 are secured by spring-loaded pins 16 to opposite ends of a standard watch casing 18.

As a further setting for the present invention, the flexible band sections 12 may be conventionally made up of a plurality of links 20 which are interconnected by transversely extending pins 22 so that the links are fastened together as shown and will permit ready addition or subtraction of links depending upon the desired length of each flexible section. In this respect, the sections are flexible in that they are free to bend or pivot about the pins so as to readily conform to the wrist of the wearer but are not necessarily stretchable or extendible in the lengthwise direction, the latter being the function of the expander section 13 to be hereinafter described. Typically the pin at the end of the flexible section away from the expander section 12 is a spring-loaded pin which is adapted to be inserted into aligned sockets at one edge of the watch casing 18. However, in order to make the flexible sections conformable for the addition of watch tips or other like pieces of jewelry between the flexible sections and the watch casing, a solid pin 23 is positioned at the free end of each flexible section away from the intermediate expander section, and the links are spaced to cross the length of each pin 23 so as to permit interconnection of each spring clip 14.

Figure 4:
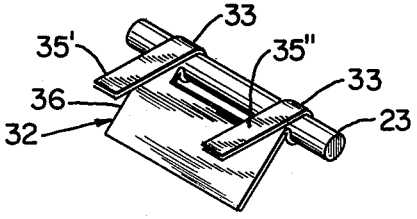
FIG. 4 is a somewhat perspective view illustrating the mounting of the spring clip on a pin normally disposed at the end of the flexible section.
Figure 5:
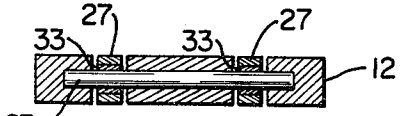
FIG. 5 is a cross-sectional view taken about lines 5—5 of FIG. 2.
Figure 6:
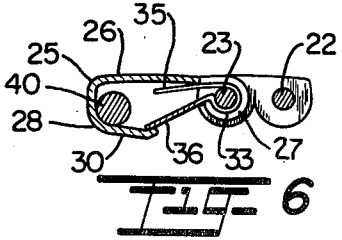
FIG. 6 is a cross-sectional view taken about lines 6—6 of FIG. 1.

As best seen from FIGS. 4 to 6, each spring clip 14 is made up of an end retainer 25 which is of generally U-shaped cross-section having a straight side 26 terminating in a curved or generally circular connecting end 27 disposed in surrounding relation to or wrapped around the pin 23; and an outer end portion 28 has a return terminating in a free end 30 spaced from the end of the flexible section 12. A spring closure 32 includes a substantially closed connecting end 33 of generally circular configuration which is disposed in concentric relation between the pin 23 and the connecting end 27 of the end retainer. Flat, generally rectangular leaf springs 35 and 36 diverge away from the connecting end for extension between the return portion 29 and closed side portion 25 of the end retainer, there being one spring portion 35 extending substantially in a tangential direction away from the pin 23 and a second spring portion 36 inclining toward and terminating just inwardly of the terminal end 30 of the end retainer and being biased in a direction to be normally urged against the inner surface of the terminal ends. As shown in FIG. 4, the spring portion 35 is preferably defined by a pair of tangentially extending fingers 35' and 35" which will resist the pressure applied against the spring 36 as the portions 35' and 35" are urged against the inner surface of the closed or straight portion 25. This will occur for example when a pin or connecting bar such as illustrated at 40 is inserted through the entrance formed between the terminal end 30 and the end of the flexible section. In this connection it will be noted that the connecting end 33 is looped around the pin 23 over its greater circumferential extent in snug-fitting relation thereto and is further supported in proper aligned relation to the end retainer by the terminal end of the outer connecting end 27 of the end retainer.

The connecting bar 40 is formed as a transversely extending member across one end of the jewelry or watch tip 15 to be connected to the spring clip and may be of any suitable configuration to blend in with the decor of the watch tip. Of course the opposite end of the watch tip may be conventionally provided with any suitable type of connecting pin such as the spring-loaded connecting pin 16 as shown for insertion between the end sockets on the edge of the watch casing 18.

A preferred form of expander section 13 is illustrated in FIGS. 7 to 9 wherein a pair of curved or arcuate longitudinally extending plates 50 and 51 are hinged together in end to end relation to one another by a common connecting pin 52 inserted through overlapping hinge portions 53 and 54 of the plate members 50 and 51, respectively. In addition, the plate 51 is provided with a transversely extending pivot pin 55 at one end opposite to the pin 52 for pivotal connection to one end of a flexible section 15. One end of the plate 50 opposite to the pin 52 is provided with a conventional form of spring-loaded, transversely extending connecting pin 56 adapted for releasable connection to an arcuate, channel-shaped clasp 58. The clasp 58 has a relatively broad curved surface 60 conforming in curvature to that of said plates 50 and 51 with spaced parallel sides 62 extending in a common direction along opposite longitudinal edges of the surface 60, each side provided with equally spaced aligned openings 64. The flexible section 15 opposite to that pivotally connected by pin 55 is also provided with a transversely extending, spring-loaded connecting pin 56' corresponding to the connecting pin 56.

Briefly, the expander section functions in accordance with conventional practice to be movable between an extended position as shown in FIG. 7 and a collapsed position as shown in FIG. 9 wherein the plates 50 and 51 are doubled upon one another and folded into a closed position beneath the clasp 58. However, in the past, the means employed for releasably fastening the plate sections together in a closed position have been unsatisfactory from the standpoint of preventing equal adjustment of the effective lengths of the flexible sections 15. In other words, in order to make adjustments in the overall length of the flexible sections, the customary practice in the past has been to adjust only one side, such as, the flexible section having the connecting pin 56 to the desired setting along the length of the spring clasp 58; otherwise, it was very difficult to close the plates 50 and 51 together and to retain them in fastened position. In order to obviate this difficulty, the plate 51 of the present invention is provided with a rounded end 68 in surrounding relation to the connecting pin 55 and which is adapted to interengage with an arcuate projection 67 on the end of the plate 51 adjacent to the pivot pin 55. In this way, both the pins 55 and 56' can be advanced to equal settings; i.e., equal spacings for insertion into aligned openings beneath the spring clasp so that in the closed position equal lengths of the flexible sections will extend away from the expander section 12 and be symmetrical with respect to the entire band. Notwithstanding adjustable or different spacings between the pins 55 and 56' as they are advanced inwardly to equal settings it has been found possible to urge the male fastener 67 into snap-fitting engagement with the rounded end 68 of the plate 51 and assure secure but releasable interconnection between the plates in the closed position.

Utilization of the expander section 13 as described in combination with the spring clips 14 affords utmost versatility in a wristband for interpositioning of various types of jewelry or watch tips between the flexible sections and the watch casing. Of course the flexible sections are merely illustrative of various different types of sections extending between an expander section and the watch tips. For example, a solid bracelet may be formed with spring clips at each end to facilitate fastening of watch tips or other items thereto in order to complete the wristband.

It is therefore to be understood that various modifications and changes may be made in the specific construction and arrangement of parts comprising the present invention without departing from the spirit and scope thereof as defined by the appended claims.

What is claimed is:

1. In a wristband having a relatively thin, flat flexible section adapted to conform to a wearer's wrist and provided with a connecting pin at one end of said section, at least the one end thereof adapted for releasable connection of an end connecting bar on a jewelry tip and the like, the improvement comprising:

a unitary end retainer having one side pivotally connected to said connecting pin secured to the one end of said flexible section and an opposite side defining a curved return portion terminating in a free end spaced from the one side to form an entrance for insertion of an end connecting bar, and a spring closure positioned within the end retainer and said spring closure including a closed connecting end of generally circular configuration pivotally connected to said connecting pin at the one end of said flexible section whereby said spring closure and said end retainer have a common pivotal connection and are pivotal in unison about said connecting pin, and flat leaf spring portions forming divergent continuations of said connecting end, one spring portion being of a length to extend between opposite sides of said end retainer, said one spring portion having its outermost edge of divergent extension biased against the inner surface of said free end and the other spring portion biased to incline in a direction away from said one spring portion toward the one side of said end retainer when said one spring portion is depressed whereby the end connecting bar may be forced past the outermost edge of said one spring portion for disposition within the curved return portion of the end retainer.

2. A wristband according to claim 1, said spring closure having said closed connecting end looped around said connecting pin at the end of said flexible section, and the one side of said end retainer looped around said closed connecting end.

3. A wristband according to claim 1, said other spring portion made up of spaced fingers and said one spring portion made up of a broad, flat spring extending in a direction to terminate with its outermost edge bearing against the inner surface of the free end of said return portion.

4. A wristband according to claim 1, there being an end retainer at each end of said flexible section, and an expansion member in said flexible section comprising arcuate, longitudinally extending plates hinged together at one end and the opposite end of each hinged end being connected to a portion of said flexible section, one pivotal end being transversely rounded and the other pivotal end having a transverse snap-on portion extending transversely of the length of the plate and projecting toward the rounded end and aligned for snug-fitting releasable engagement over said one pivotal end.

5. A wristband according to claim 4, wherein said flexible section has an outer channel-shaped cover plate with a series of longitudinally spaced openings along opposite sides, and a spring-loaded pin on said flexible section insertable in an aligned pair of said spaced openings.

6. In a wristband having a relatively thin, flat flexible section adapted to conform to the wearer's wrist and a connecting pin at one end of said section, at least one end thereof adapted for releasable connection of an end connecting bar on a jewelry tip and the like, the improvement comprising:

an end retainer plate having one side in the form of a looped portion pivotally connected to said connecting pin at the one end of said flexible section and an opposite side defining a return portion terminating in a free end spaced from the one side to form an entrance for insertion of an end connecting bar, a spring closure including a looped connecting end of arcuate configuration pivotally connected to said connecting pin whereby said spring closure and said end retainer plate have a common pivotal connection and are pivotal in unison about said connecting pin, and flat, generally rectangular leaf spring portions defining oppositely divergent extensions of said looped connecting end for extension between opposite sides of said end retainer, one spring portion diverging away from said one side of said end retainer to terminate in an edge of outermost divergent extension against the inner surface of the free end of said return portion, and the other spring portion biased against the one side of said end retainer whereby the end connecting bar may be forced past the outermost edge of said one spring portion for disposition within the return portion of the end retainer.

* * * * *